US005163621A

United States Patent [19]

Kato et al.

[11] Patent Number: 5,163,621

[45] Date of Patent: Nov. 17, 1992

[54] FUEL INJECTION VALVE HAVING DIFFERENT FUEL INJECTION ANGLES AT DIFFERENT OPENING AMOUNTS

[75] Inventors: Masaaki Kato, Kariya; Hiroyuki Kano, Nagoya; Masahiro Okajima; Yoshihiro Narahara, both of Kariya; Tertada Kojima, Nagoya; Shigeki Tojo, Mie, all of Japan

[73] Assignee: Nippondenso Co., Ltd., Japan

[21] Appl. No.: 624,104

[22] Filed: Dec. 10, 1990

[30] Foreign Application Priority Data

Dec. 12, 1989 [JP] Japan ..... 01-321655

[51] Int. Cl.[5] ..... F02M 61/18

[52] U.S. Cl. ..... 239/533.12; 239/533.3; 239/584

[58] Field of Search ..... 239/533.2, 533.3, 533.4, 239/533.9, 533.12, 584

[56] References Cited

U.S. PATENT DOCUMENTS

| | | | |
|---|---|---|---|
| 3,836,080 | 9/1974 | Butterfield et al. | 239/533.4 X |
| 4,721,253 | 1/1988 | Noguchi et al. | 239/533.12 X |
| 4,801,095 | 1/1989 | Banzhaf et al. | 239/533.3 |
| 4,934,599 | 6/1990 | Hasagawa | 239/533.9 X |

FOREIGN PATENT DOCUMENTS

| | | | |
|---|---|---|---|
| 3834235 | 4/1989 | Fed. Rep. of Germany | 239/533.9 |
| 2229868 | 12/1974 | France | 239/533.2 |
| 222971 | 12/1983 | Japan | 239/533.2 |
| 59-154860 | 10/1984 | Japan . | |
| 60-142051 | 7/1985 | Japan . | |
| 61-15251 | 1/1986 | Japan . | |
| 565299 | 11/1944 | United Kingdom | 239/584 |
| 20348166 | 6/1980 | United Kingdom | 239/533.3 |

*Primary Examiner*—Andres Kashnikow
*Assistant Examiner*—William Grant

[57] ABSTRACT

A fuel injection valve of a diesel engine, comprising a valve body including a concave conical surface in the tip portion of the valve body, and fuel injection holes extending from the concave surface to the outside of the valve body, and a needle valve movable in the valve body and including a cylindrical shaft portion, a first conical surface adjacent to the shaft portion and having a conical angle smaller than that of the concave surface, the lower edge of the first conical surface defining a contact line separably contacting with the concave surface, a second conical surface adjacent to the first surface and having a conical angle substantially equal to that of the concave surface, a third conical surface adjacent to the second surface and having a conical angle greater than that of the concave surface. In case of a smaller lift amount of the needle valve, the fuel flow speed flowing into the fuel injection hole is fast and the atomized fuel injection divergence angle from the injection hole is great, thereby producing active producing mixing of the fuel with the air and enhancing the ignition feature, while in case of a greater lift amount, the fuel flow speed is slow and the atomized fuel injection divergence angle from the injection hole is small, thereby increasing the fuel flow reach and producing an active mixing of the fuel with the air by virtue of the kinetic energy of the atomized fuel flow.

17 Claims, 9 Drawing Sheets

FUEL INJECTION VALVE HAVING DIFFERENT FUEL INJECTION ANGLES AT DIFFERENT OPENING AMOUNTS

BACKGROUND OF THE INVENTION

1. Field of the Invention

The present invention relates to a fuel injection valve used in a fuel injection apparatus for injecting fuel into a diesel engine.

2. Description of the Prior Art

In a fuel injection apparatus of a diesel engine, there are required a high injection pressure, a variable injection timing, and a variable fuel injection rate for providing measures to counter engine exhaust gas or particulates pollution, and in a fuel injection valve, it is required to decrease a sack volume, which is a volume between an injection valve seat and a nozzle hole opening to an engine combustion chamber measured in a closed valve condition. For an example, a suckless nozzle 1 shown in FIG. 13 has been proposed.

The suckless nozzle 1 is composed of a valve body 2 having a concave conical surface 22, a recess 23, and fuel injection holes 24, 25 at the inside of the tip of the valve body, and of a needle valve 3 having a cylindrical shaft portion 31, a first conical surface 32 and a second conical surface 33.

In this arrangement, however, when the lift of the needle valve is small, there appears only a narrow gap between the valve body 2 and the needle valve 3. In consequence, the most portion of the pressurized fuel flows through this narrow gap with a high speed towards the recess 23 which is provided for the convenience of fabrication, but not into the fuel injection holes 24, 25, and only a small portion of the fuel flowing into the fuel injection holes flows mainly towards the lower side of the fuel injection holes thereby making the contraction coefficient of the fuel flow very small. As a result, the atomized fuel flows asymmetrically through the outlet regions of the fuel injection holes 24, 25, and the fuel injection angle increases, thereby causing an insufficient fuel flow reach and a deteriorated combustion in the engine.

Further, for solving the problem relating to a sackless nozzle, there is a proposal (SAE 860416) that an annular needle sack is to be formed at the tip of the needle valve. This arrangement, however, has a problem that the fuel flow feature may be rapidly changed, and an inconvenient change of the relation between a needle valve lift amount and a fuel flow sectional area is caused, thereby making it difficult to apply this arrangement to a nozzle having a great lift.

SUMMARY OF THE INVENTION

The object of the present invention is to provide a fuel injection valve which has a small sack volume and an excellent atomized fuel injection feature.

For achieving the above-mentioned object, according to the present invention, there is provided a fuel injection valve of a diesel engine, comprising a valve body including a fuel passage inside thereof, a concave conical surface formed in the tip portion of the valve body, and at least one fuel injection hole extending from said concave conical surface to the outside of the valve body with a slant angle relative to the central axis of the valve body, and a needle valve movable in said valve body and including a cylindrical shaft portion, a first conical surface adjacent to the tip portion of said cylindrical shaft portion and having a conical angle smaller than that of the concave conical surface of the valve body, the lower edge of the first conical surface defining a contact line separably contacting with the concave conical surface of the valve body, a second conical surface adjacent to the tip portion of the fist conical surface and having a conical angle substantially equal to that of the concave conical surface of the valve body, a third conical surface adjacent to the tip portion of the second conical surface and having a conical angle greater than that of the concave conical surface of the valve body, and a plurality of slant grooves formed on at least one of the cylindrical shaft portion, the first conical surface, the second conical surface and the third conical surface for swirling the fuel flow passing through the fuel passage, the fuel injection hole being located downstream of the contact line when the contact line contacts with the concave conical surface of the valve body.

There is further provided a fuel injection valve of a diesel engine, comprising a valve body including a fuel passage inside thereof, a concave conical surface formed in the tip portion of the valve body, and at least one fuel injection hole extending from the concave conical surface to the outside of the valve body with a slant angle relative to the central axis of the valve body, and a needle valve movable in the valve body and including a cylindrical shaft portion, a first conical surface adjacent to the tip portion of the cylindrical shaft portion and having a conical angle smaller than that of the concave conical surface of the valve body, the lower edge of the first conical surface defining a contact line separably contacting with the concave conical surface of the valve body, a second conical surface adjacent to the tip portion of the first conical surface and having a conical angle substantially equal to that of the concave conical surface of the valve body, and a third conical surface adjacent to the tip portion of the second conical surface and having a conical angle greater than that of the concave conical surface of the valve body, the fuel injection hole being located downstream of the contact line when the contact line contacts with the concave conical surface of the valve body, and fuel swirling means arranged in the fuel passage for swirling the fuel flow through the fuel passage around the needle valve.

Still further, there is provided a fuel injection valve of a diesel engine, comprising a valve body including a fuel passage inside thereof, a concave conical surface formed in the tip portion of the valve body, and at least one fuel injection hole extending from the conical surface to the outside of the valve body with a slant angle relative to the central axis of the valve body, and a needle valve movable in said valve body and including a cylindrical shaft portion, a seat portion adjacent to the tip portion of the cylindrical shaft portion and separably contacting with the concave conical surface of the valve body, and a fuel flow rate control portion formed at the lower end of the seat portion for increasing the sectional area of the fuel flow passage when the needle valve is lifted, the fuel injection hole being located downstream of the seat portion when the seat portion contacts with the concave conical surface of the valve body, and fuel swirling means arranged in the fuel passage for swirling the fuel flow through the fuel passage around the needle valve.

DESCRIPTION OF THE PREFERRED EMBODIMENT

Figure 1:
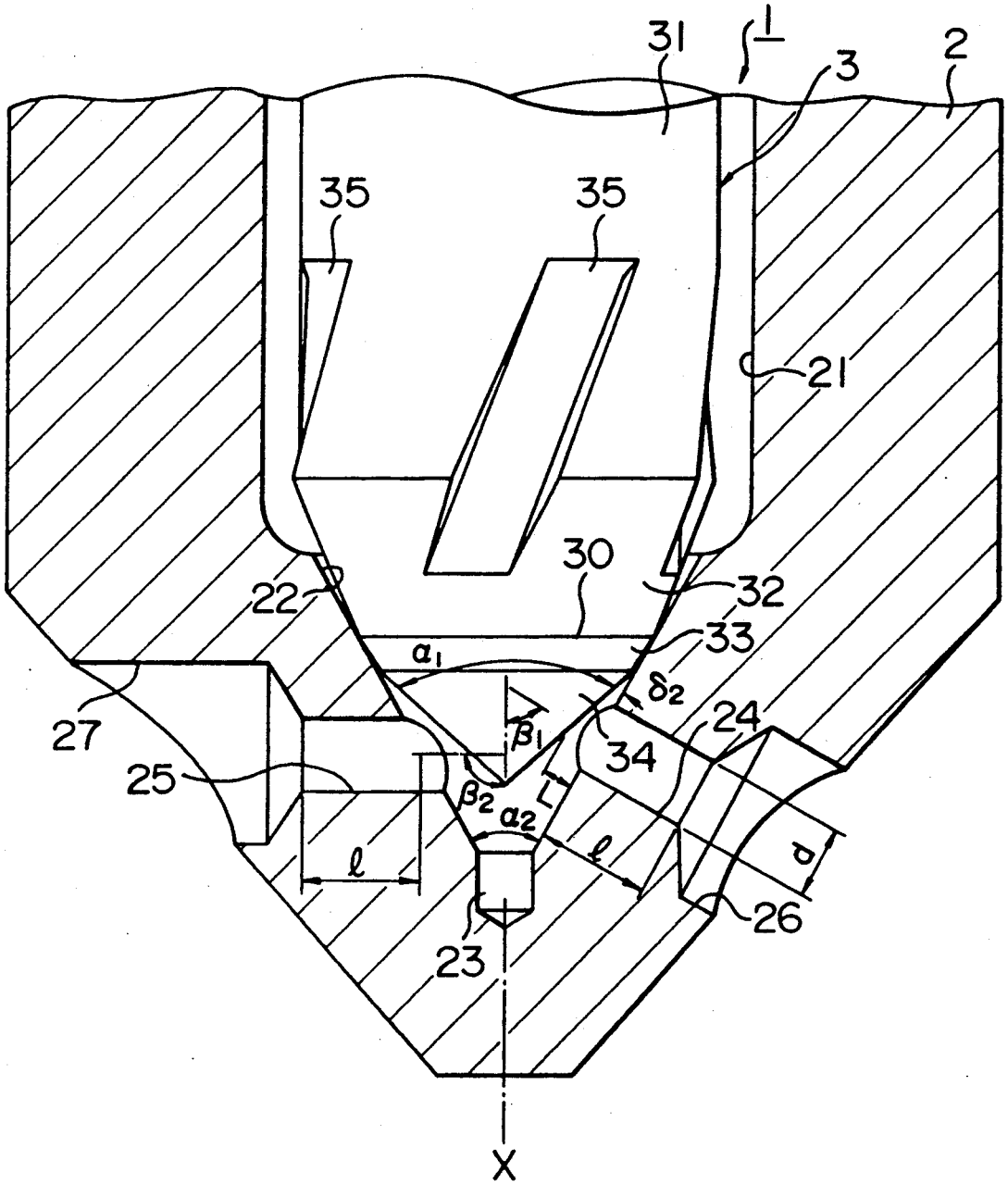
FIG. 1 is a longitudinal sectional view of tip portion of a fuel injection valve according to an embodiment of the present invention.
Figure 2:
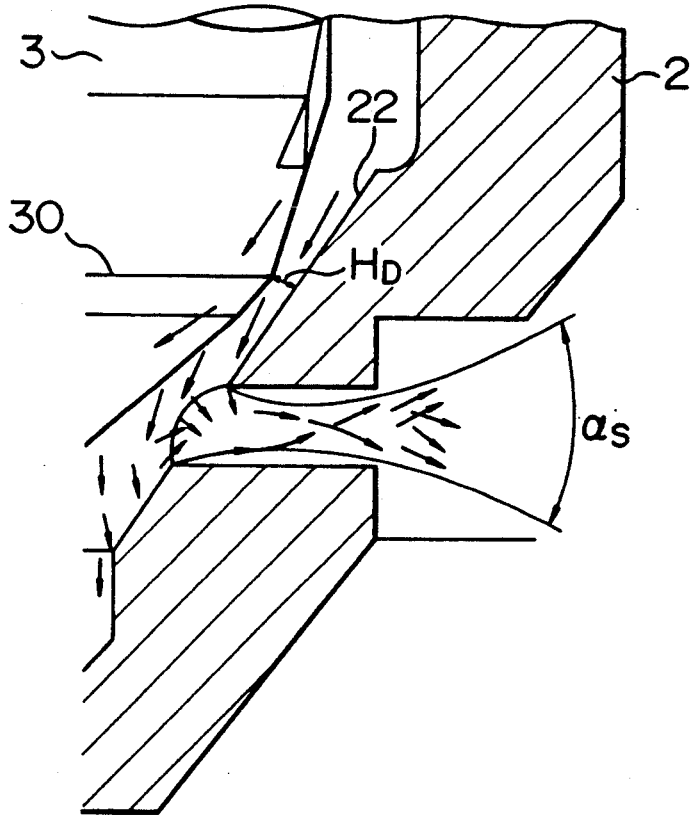
FIGS. 2 and 3 are illustrations showing a fuel flow pattern in case of a small lift of a needle valve of a fuel injection valve according to the present invention.

Referring to FIG. 1, a fuel injection valve 1 according to an embodiment of the present invention is composed of a valve body 2 and a needle valve 3, and the needle valve 3 is inserted movably in the valve body 2 and radially supported by a guide portion not shown.

The valve body 2 is installed in a direction towards a combustion chamber of an internal combustion engine not shown. In the tip portion of the valve body 2, there are formed a cylindrical bore 21, a concave conical surface 22, a recess 23 for fabrication convenience and fuel injection holes 24, 25 making communication between the inside of the concave conical surface 22 and the outside of the valve body 2, and the fuel injection holes 24, 25 are formed with spot facings 26, 27, respectively, so as to make the holes 24 and 25 have the same length l. The angle $\beta_1$ of the axis of the fuel injection hole 24 relative to the central axis X is determined to be smaller than the angle $\beta_2$ of the axis of the fuel injection hole 25 relative to the central axis X.

The needle valve 3 includes a cylindrical shaft portion 31, a first conical surface 32 continuous to the cylindrical portion 31 and having a conical angle smaller than the conical angle $\alpha_2$ of the concave conical surface 22 of the valve body 2, a second conical surface 33 continuous to the first conical surface 32 along a circular contact line 30 contacting with the conical surface 22 and having a conical angle slightly greater than the conical angle $\alpha_2$ of the conical surface 22, and a third conical surface 34 continuous to the second conical surface 33 and having a conical angle $\alpha_1$ greater than the conical angle $\alpha_2$ of the conical surface 22. By feeding high pressure fuel from a fuel injection pump (not shown) into a cylindrical bore 21 of the valve body 2, the needle valve 3 is pushed in a valve opening direction (upwards in the figure), while the needle valve 3 is subjected at all times to a pushing force acting in a valve closing direction (downwards in the figure) by means of a elastic member. In consequence, by cylindrically feeding the high pressure fuel, a reciprocal motion of the needle valve 3 can be obtained.

The cylindrical shaft portion 31 and the first conical surface 32 of the needle valve 3 are formed with a plurality of slant grooves 35, by virtue of which the fuel fed into the cylindrical hole 21 flows as swirling around the needle valve 3.

The operation of this embodiment will be described below.

Figure 3:
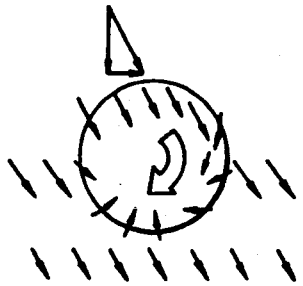

In case the lift amount of the needle valve 3 is small, the distance $H_D$ between the concave conical surface 22 of the valve body 2 and the contact line 30 of the needle valve 3 is small, and accordingly, the fuel flow sectional area defined by the concave conical surface 22 and the contact line 30 is also small. As a result, the fuel flow mass rate is small, and the fuel flow speed is high. In this flow condition, the swirling fuel flow produced by the slant grooves 35 has a high flow speed in the circumferential direction, and under the strong influence of the high speed circumferential fuel flow, the fuel flows into the injection holes 24, 25 in a slanted direction relative to the central axis X. Arrows in the figure indicate velocity vectors of the fuel flow. Since, at the inlet portions of the injection holes 24, 25, the fuel flow sectional area is rather wide, and accordingly, the fuel flow speed is rather low, the fuel flows through the injection holes 24, 25 in a swirling direction as shown in FIG. 3.

Figure 4:
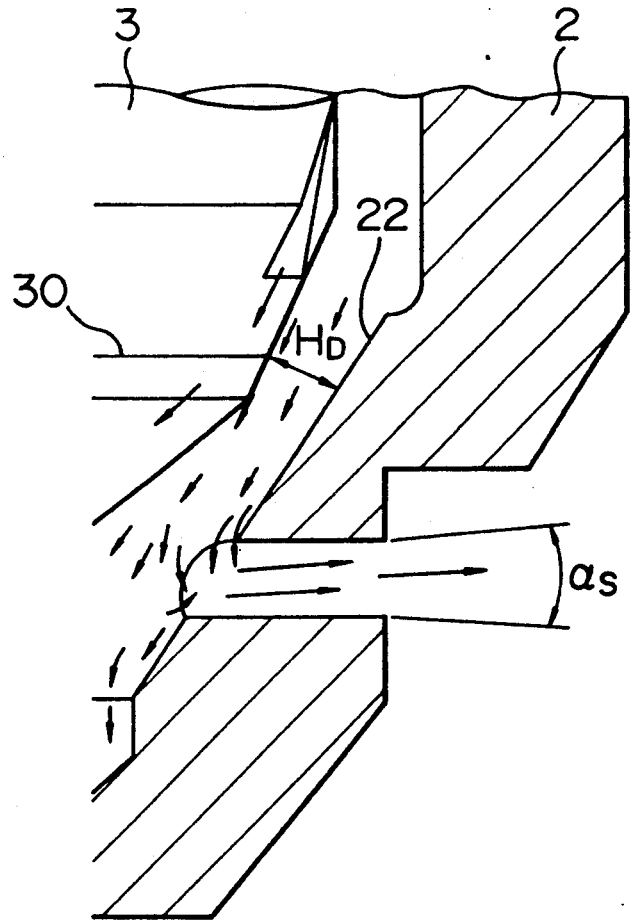
FIGS. 4 and 5 are illustrations showing a fuel flow pattern in case of a great lift of a needle valve of a fuel injection valve according to the present invention.
Figure 5:
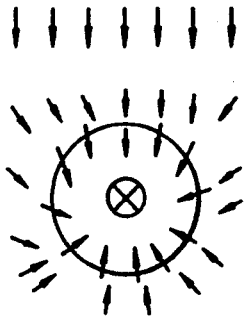

Thereafter, when the lift amount of the needle valve 3 is increased, as shown in FIG. 4, the distance $H_D$ between the concave conical surface 22 of the valve body 2 and the contact line 30 of the needle valve 3 becomes greater and the fuel flow sectional area defined by the concave conical surface 22 and the contact line 30 becomes also greater, resulting in that the fuel flow mass rate is increased, the fuel flow speed is decreased and the fuel flows mainly along the central axis X. Further, at the inlet portion of the injection holes 24, 25, the speed of the fuel flow is decreased and, on the contrary, the pressure of the same is increased. As a result, the fuel flows into the injection holes 24, 25 uniformly from the whole periphery of the inlet of the fuel holes.

Figure 6:
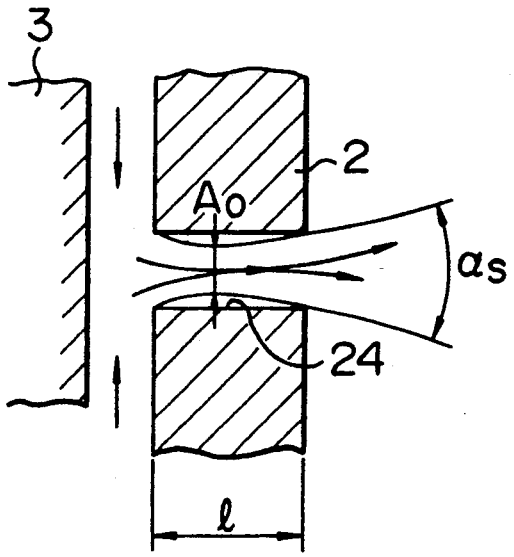
FIGS. 6 and 7 are illustrations showing the basic principle of the present invention in a small lift condition of the needle valve and in a great lift condition of the same, respectively.
Figure 7:
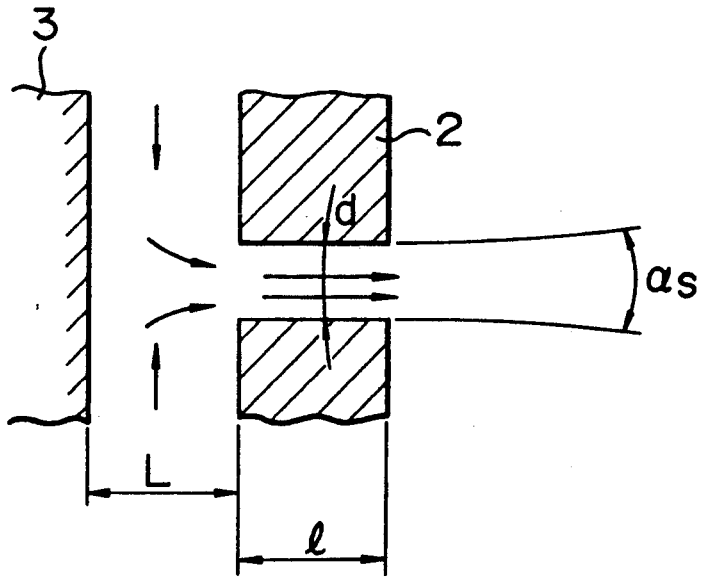

Next, referring to FIGS. 6 and 7, the basic principle of this fuel injection characteristic is explained. FIGS. 6 and 7 are schematic illustrations showing how the fuel injection characteristic varies as the distance between the needle valve 3 and the valve body 2, and accordingly, the distance between the needle valve 3 and the injection hole 24 become greater due to an increase of the lift amount of the needle valve 3, wherein FIG. 6 shows a case of a small lift amount, while FIG. 7 a case of a great lift amount.

In case of a small lift amount, as shown in FIG. 6, the gap between the needle valve 3 and the valve body 2 is narrow, and the fuel fed with a high pressure flows with a high speed through the gap between the needle valve 3 and the valve body 2, thereby causing a severe flow contraction loss and a considerably small minimum contraction area $A_o$ in the injection hole 24. This means that the contraction coefficient becomes considerably small. Since the once contracted fuel flow has compressibility, the fuel rapidly expands radially in the injection hole 24 and is injected into the combustion chamber with an atomized fuel injection angle $\alpha_S$. Therefore, when the length l of the injection hole 24 is suitably selected so that the expanded fuel flow does not collide with the inner wall of the injection hole 24, the fuel can be injected into a combustion chamber (not shown) with an atomized fuel injection angle $\alpha_S$.

In case of a great lift amount, as shown in FIG. 7, the gap between the needle valve 3 and the valve body 2 is wide, and the flow speed of the fuel flowing through the gap between the needle valve 3 and the valve body 2 is decreased, thereby generating substantially no flow contraction. Even if some flow contraction is generated, it may be straightened without delay, and most portions of the fuel flow parallel to the axis of the injection hole and the atomized fuel injection angle $\alpha_S$ becomes small.

In conclusion, in case of a small lift amount of the needle valve 3, the atomized fuel injection angle $\alpha_S$ is great, thereby producing an active mixing of the fuel with the air and enhancing an ignition feature of the fuel, while when there is a great lift amount of the needle valve 3, the atomized fuel injection angle $\alpha_S$ becomes small and the reach distance of the fuel becomes long, thereby facilitating the mixing of the fuel with the air owing to the increased kinetic energy of the atomized fuel.

Figure 8:
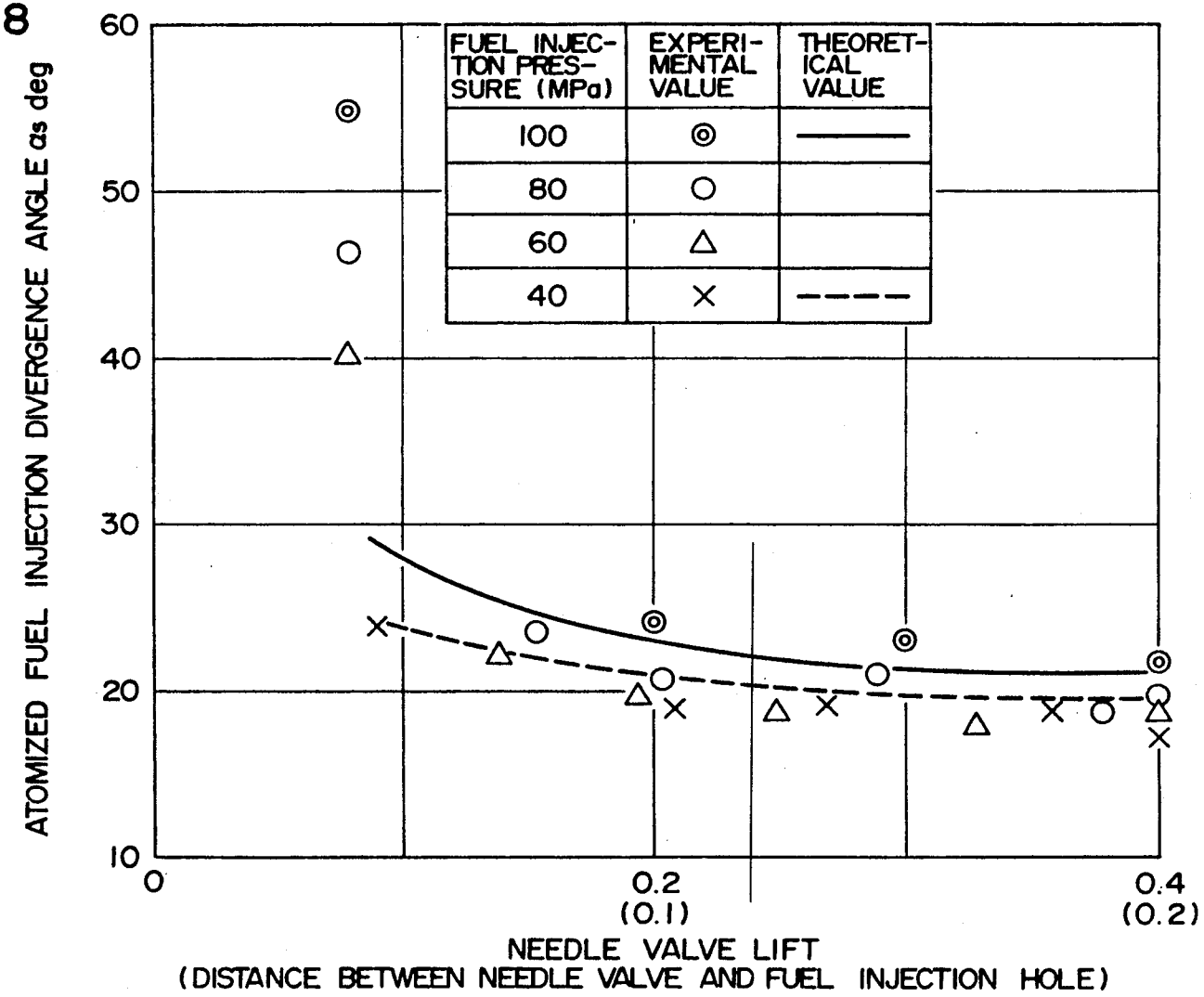
FIG. 8 is a diagram showing a relation between the lift amount of the needle valve and the atomized fuel divergence angle.

FIG. 8 shows a relation between the lift amount $H_D$ of the needle valve 3 (the distance from the needle valve 3 to the injection hole 24), and the atomized fuel angle $\alpha_S$, this relation being confirmed by an experiment, where ◎, ○, Δ and X correspond to injection pressures 100 MPa, 80 MPa, 60 MPa and 40 MPa, respectively, the solid line is a theoretical curve in case of injection pressure of 100 MPa, and the broken line is a theoretical curve in case of injection pressure of 40 MPa. It is obvious from FIG. 8 that as the lift amount increases, the atomized fuel injection angle decreases.

Figure 9:
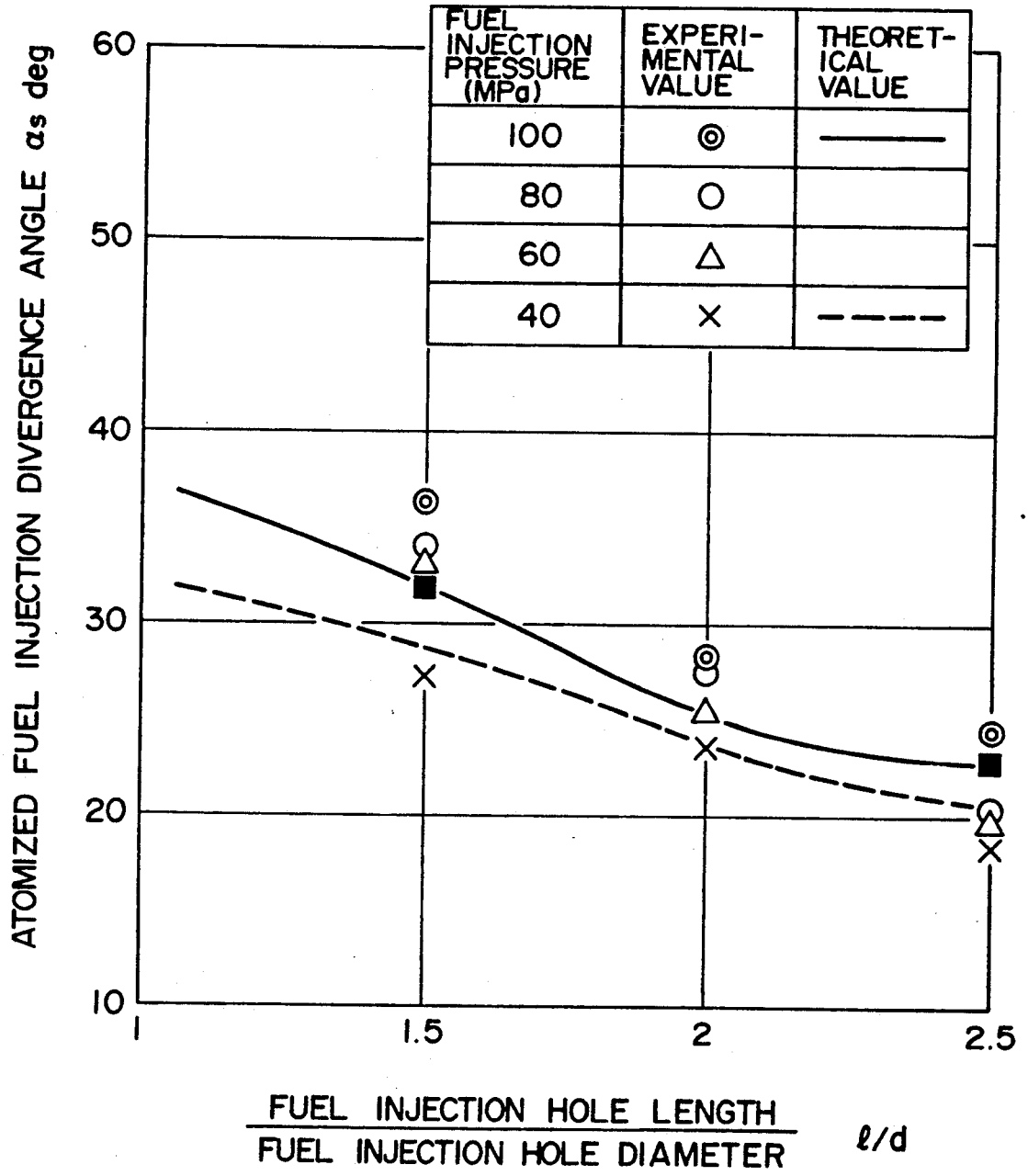
FIG. 9 is a diagram showing a relation between the ratio of the fuel injection hole length to the fuel injection hole diameter and the atomized fuel divergence angle.

The fuel injection feature of the fuel injection valve 1 is made to conform to the feature of the engine by adjusting the diameter d and the length l of the injection hole 24. FIG. 9 shows a relation between the atomized fuel injection angle $\alpha_S$ and the ratio l/d of the length l of the injection hole 24 to the diameter d of the same, where, similarly to in FIG. 8, ◎, ○, Δ and X correspond to injection pressures 100 MPa, 80 MPa, 60 MPa and 40 MPa, respectively, the solid line is a theoretical curve in case of injection pressure of 100 MPa, and the broken line is a theoretical curve in case of injection pressure of 40 MPa. Thus, by adjusting the ratio l/d of the length l of the injection hole 24 to the diameter d of the same, the atomized fuel injection angle, in other words, the reach distance of the fuel can be controlled.

Figure 10:
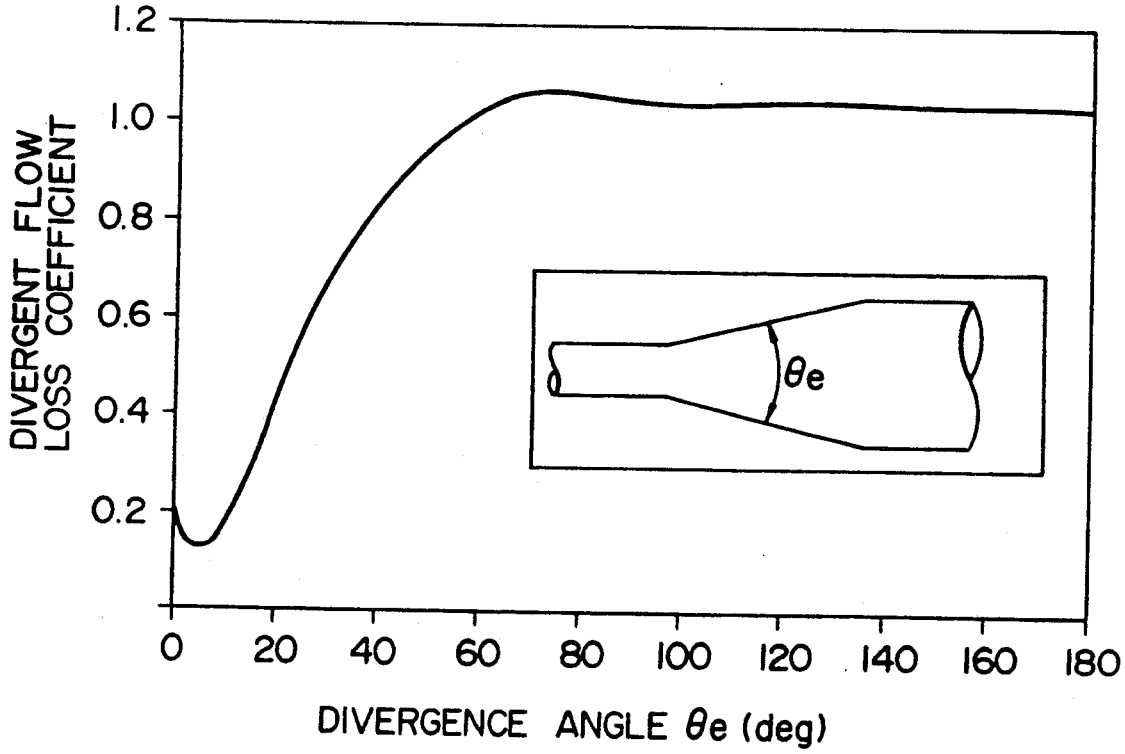
FIG. 10 is a diagram showing a relation between the fuel divergence angle and the fuel divergence loss coefficient.

Further, the angle $\delta_2$ between the third conical surface 34 and the concave conical surface 22 is determined in a range from 7° to 15° so as to minimize the divergence loss of the fuel flowing from the gap between the contact line 30 and the concave conical surface 22, and to maintain a suitable distance between the third conical surface 34 and the inlet of the injection hole. FIG. 10 shows a relation between the divergence angle $\theta_e$ and the divergence loss coefficient $\zeta_e$, from which it is known that the divergence loss coefficient $\zeta_e$ is low in a range from 0° to 15° of $\theta_e$.

Figure 11:
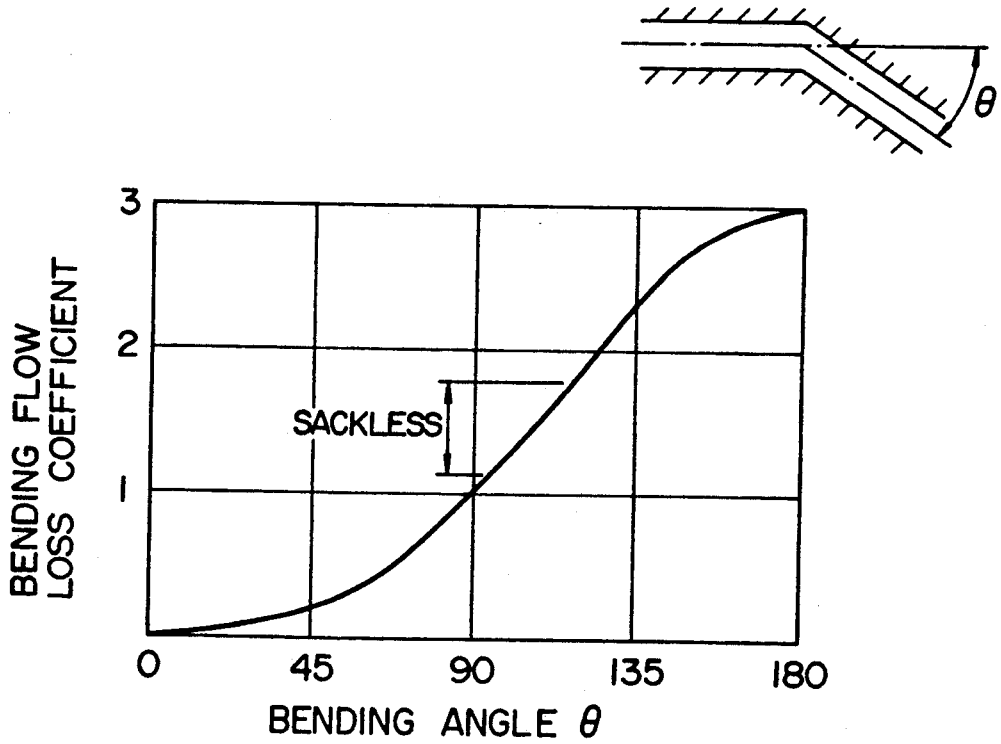
FIG. 11 is a diagram showing a relation between the fuel path bending angle and the fuel flow bending loss coefficient.

In this embodiment, in order to make uniform the bending flow loss, the positions of the inlets of the injection holes 24 and 25 are deviated from each other according to the angles $\beta_1$ and $\beta_2$, respectively. Namely, as the $\beta$ decreases, the fuel flow bending angle $\theta(\theta=\beta+\alpha_2/2)$ also decreases and the bending flow loss becomes low. FIG. 11 shows a relation between the flow bending angle $\theta$ and the bending flow loss coefficient $\zeta_\theta$, from which it is known that, as the flow bending angle $\theta$ decreases, the bending flow loss coefficient $\zeta_\theta$ becomes smaller. Further, since the bending flow loss is proportional to the square of fuel flow speed, the inlet of the injection hole 25 having a greater bending flow loss coefficient is positioned lower than the inlet of the injection hole 24 having a smaller bending flow loss coefficient for making the fuel flow speed pouring into the injection hole 25 slower than that into the injection hole 24. As a result, the injection holes 24 and 25 have the substantially same bending flow loss.

Figure 12:
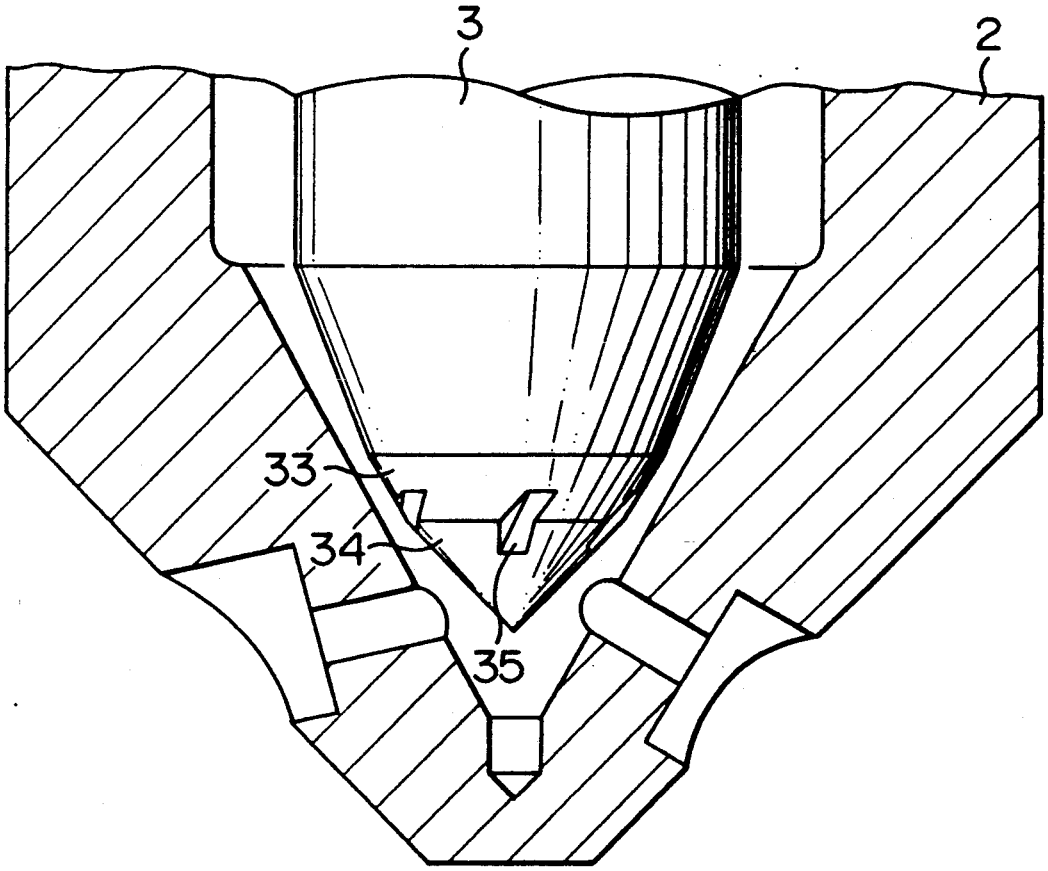
FIG. 12 is a longitudinal sectional view of tip portion of a fuel injection valve according to another embodiment of the present invention.
Figure 13:
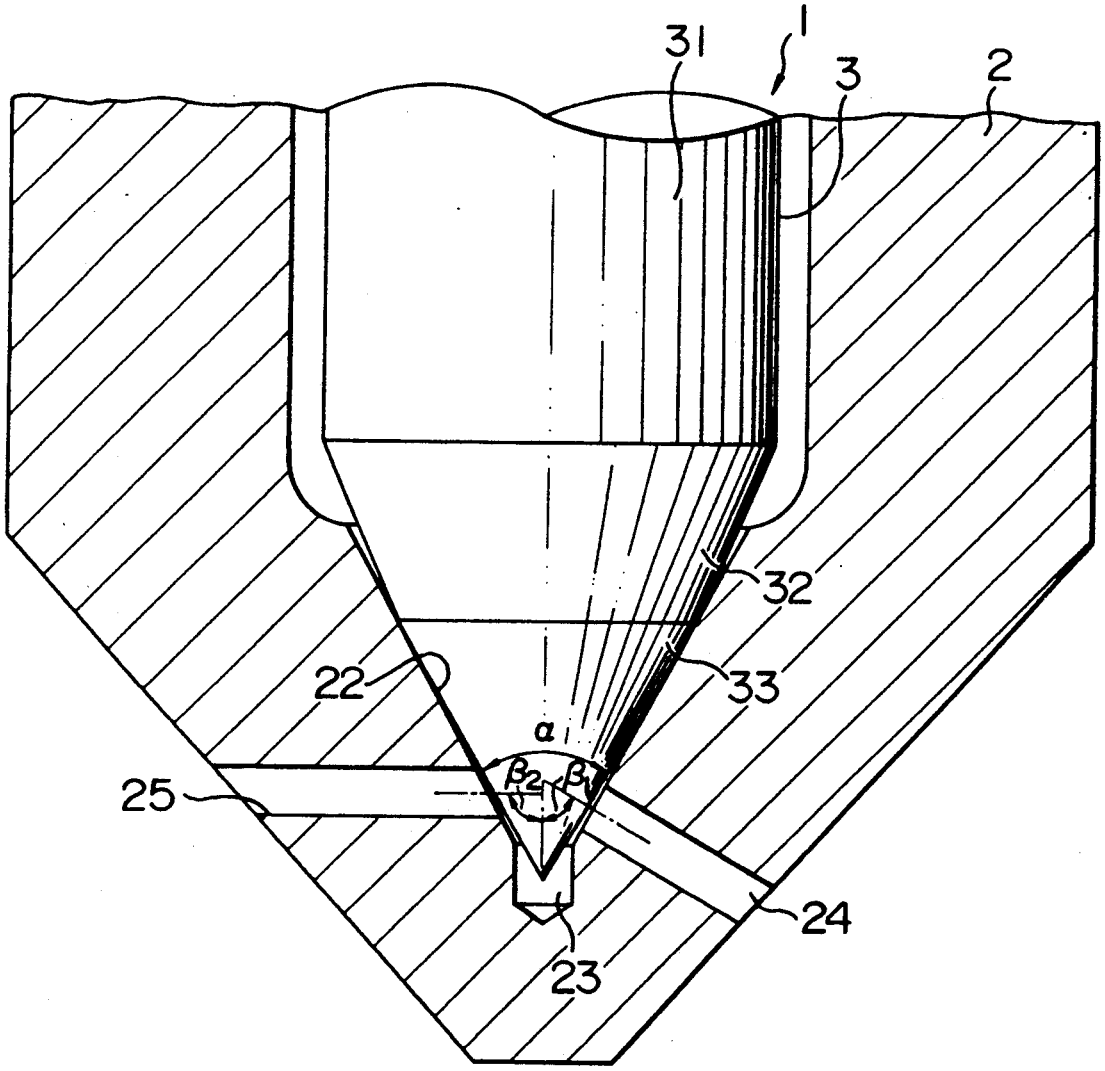
FIG. 13 PRIOR ART
FIG. 13 is a longitudinal sectional view of tip portion of a fuel injection valve of a prior art.

FIG. 12 shows another embodiment according to the present invention, wherein the slant grooves 35 are formed on the second conical surface 33 and the third conical surface 34.

As described above, according to the present invention, in case of a smaller lift amount of the needle valve, the fuel flow speed is fast due to the narrow flow sectional area between the conical surface of the valve body and the contact line, the atomized fuel injection angle from the injection hole is great, thereby producing active mixing of the fuel with the air and enhancing the ignition feature, while in case of a greater lift amount of the needle valve, the fuel flow speed is slower due to the wider flow sectional area between the conical surface of the valve body and the contact line, the atomized fuel injection angle from the injection hole is smaller, thereby increasing the fuel flow reach and producing an active mixing of the fuel with the air by virtue of the kinetic energy of the atomized fuel flow.

What is claimed is:

1. A fuel injection valve, comprising:

a valve body including a fuel passage inside thereof, a concave conical surface formed in the tip portion of the valve body, and a plurality of fuel injection holes extending from said concave conical surface to an outside of the valve body with a slant angle relative to a central axis of the valve body, and a needle valve movable in said valve body and including a cylindrical shaft portion, a conical surface adjacent to a tip portion of said cylindrical shaft portion and having a conical angle with respect to said central axis smaller than that of said concave conical surface of the valve body, a lower edge of the conical surface defining a contact line separably contacting with said concave conical surface of the valve body, and a control surface formed in a tip portion of the needle valve to face said plurality of fuel injection holes, having a conical angle with respect to said central axis greater than said slant angle of said concave conical surface of the valve body and arranged such that a distance between the control surface and each said fuel injection hole becomes greater when a lift amount of the needle valve, which separates said needle valve from said valve body, is increased, said fuel injection hole being located downstream of said contact line when said contact line contacts with said concave conical surface of the valve body;

wherein said needle valve further includes a second conical surface between said first conical surface adjacent to the tip portion of said cylindrical shaft portion and said control surface, said second conical surface having a conical angle substantially equal to that of said concave conical surface of the valve body.

2. A fuel injection valve claimed in claim 1, wherein a difference in angles between said concave conical surface of the valve body and said control surface of the needle valve is in a range from 7° to 15°.

3. A fuel injection valve claimed in claim 1, wherein each of said plurality of fuel injection holes have parallel axes which form angles different from each other relative to said concave conical surface.

4. A fuel injection valve claimed in claim 3, wherein, among said plurality of fuel injection holes, a fuel injection hole forming a greater slant angle relative to the central axis of the valve body is positioned such that the inlet thereof opens nearer to the tip portion of said concave conical surface of the valve body than one having a lesser slant angle.

5. A fuel injection valve claimed in claim 1, wherein said fuel passage comprises a cylindrical bore formed around said needle valve.

6. A fuel injection valve claimed in claim 1, wherein each of said fuel injection holes is formed with an enlarged facing portion at the outlet portion thereof for making lengths of the fuel injection holes equal to each other.

7. A fuel injection valve claimed in claim 6, wherein a diameter of said facing portion is determined so that the fuel injected from the fuel injection hole does not collide with the wall downstream of the facing portion.

8. A fuel injection valve claimed in claim 1, wherein said needle valve further includes a plurality of slant grooves formed on at least one of the cylindrical shaft portion, the first conical surface, the second conical surface and the control surface for swirling the fuel flow passing through said fuel passage.

9. A fuel injection valve, comprising:

a valve body including a fuel passage inside thereof, a concave conical surface formed in a tip portion of the valve body, and a plurality of fuel injection holes extending from said concave conical surface to an outside of the valve body with a slant angle relative to a central axis of the valve body, a needle valve movable in said valve body and including a cylindrical shaft portion, a conical surface adjacent to a tip portion of said cylindrical shaft portion and having a conical angle with respect to said central axis smaller than that of said concave conical surface of the valve body, a lower edge of the conical surface defining a contact line separably contacting with said concave conical surface of the valve body, and a control surface formed in a tip portion of the needle valve to face said plurality of fuel injection holes, having a conical angle with respect to said central axis greater than said slant angle of said concave conical surface of the valve body and arranged such that the distance between the control surface and each said fuel injection hole becomes greater due when a lift amount of the needle valve, with separates said needle valve from said valve body, is increased, said fuel injection hole being located downstream of said contact line when the contact line contacts with said concave conical surface of the valve body, and fuel swirling means arranged in said fuel passage for swirling the fuel flow through the fuel passage around said needle valve;

wherein said needle valve further includes a second conical surface between said first conical surface adjacent to the tip portion of said cylindrical shaft portion and said control surface, said second conical surface having a conical angle substantially equal to that of said concave conical surface a the valve body.

10. A fuel injection valve claimed in claim 9, wherein a difference in angles between said concave conical surface of the valve body and said control surface of the needle valve is in a range from 7° to 15°.

11. A fuel injection valve claimed in claim 9, wherein each of said plurality of fuel injection holes have parallel axes which form angles different from each other relative to said concave conical surface.

12. A fuel injection valve claimed in claim 11, wherein, among said plurality of fuel injection holes, a fuel injection hole forming a greater slant angle relative to the central axis of the valve body as taken from the tip of the valve body is positioned such that the inlet thereof opens nearer to the tip portion of said concave conical surface of the valve body than one having a lesser slant angle.

13. A fuel injection valve, comprising:

a valve body including a fuel passage inside thereof, a concave conical surface formed in a portion of the valve body, and a plurality of fuel injection holes extending from said conical surface to an outside of the valve body with a slant angle relative to the central axis of the valve body, and a needle valve movable in said valve body and including a cylindrical shaft portion, a seat portion adjacent to a tip portion of said cylindrical shaft portion and separably contacting with said concave conical surface of the valve body, and a fuel flow rate control portion formed at a lower end of said seat portion to face said plurality of fuel injection holes, having a conical angle greater than that of said concave conical surface of the valve body and arranged such that the distance between the control portion and each said fuel injection hole is increased when a lift amount of the needle valve, which separates said needle valve from said valve body, is increased, said fuel injection hole being located downstream of said seat portion when said seat portion contacts with said concave conical surface of the valve body;

wherein said needle valve further includes a second conical surface between said first conical surface adjacent to the tip portion of said cylindrical shaft portion and said control portion, said second conical surface having a conical angle substantially equal to that of said concave conical surface of the valve body.

14. A fuel injection valve claimed in claim 13, wherein each of said plurality of fuel injection holes have parallel axes which form angles different from each other relative to said concave conical surface.

15. A fuel injection valve claimed in claim 14, wherein, among said plurality of fuel injection holes, a fuel injection hole forming a greater slant angle relative to the central axis of the valve body as taken from the tip of the valve body is positioned such that the inlet thereof opens nearer to the tip portion of said concave conical surface of the valve body than one having a lesser slant angle.

16. A fuel injection valve claimed in claim 13, wherein fuel swirling means is arranged in said fuel passage for swirling the fuel flow through the fuel passage around said needle valve.

17. A fuel injection valve, comprising:

a valve body including: a) surfaces forming a fuel passage inside thereof, b) a concave conical surface formed in a tip portion of the valve body, having an angle relative to a central axis of the valve body, and c) surfaces forming a plurality of fuel injection holes extending from said concave conical surface to outside of the valve body, and a needle valve movable in said valve body and including a cylindrical shaft portion with a lowermost tip portion, a conical surface adjacent to the tip portion of said cylindrical shaft portion and having a conical angle with respect to said central axis smaller than that of said concave conical surface of the valve body, a lower edge of the conical surface defining a contact line separably contacting with said concave conical surface of the valve body, and a control surface formed in a tip portion of the needle valve to face said plurality of fuel injection holes, having a conical angle with respect to said central axis greater than that of said concave conical surface of the valve body, said surfaces of said valve body and needle valve formed such that a distance between the control surface and each said fuel injection holes becomes greater when a lift amount of the needle valve, which separates said needle valve from said valve body, is increased, and such that when the distance becomes smaller, an atomized fuel injection angles from the injection hole is increased due to an increased fuel flow speed, but when the distance becomes larger, a wider flow sectional area and reduced fuel flow speed is obtained, said fuel injection hole being located downstream of said contact line when the contact line contacts with said concave conical surface of the valve body;

wherein said needle valve further includes a second conical surface between said first conical surface adjacent to the tip portion of said cylindrical shaft portion and said control surface, said second conical surface having a conical angle substantially equal to that of said concave conical surface of the valve body.

* * * * *